United States Patent [19]

Di Gaetano

[11] 4,213,730

[45] Jul. 22, 1980

[54] DEVICE FOR USE IN COUNTING SMALL ITEMS

[76] Inventor: Nicholas A. Di Gaetano, 450 Merrimac Blvd., Port Orange, Fla. 32019

[21] Appl. No.: 18,231

[22] Filed: Mar. 7, 1979

[51] Int. Cl.[3] ..... B65B 67/02; G07D 9/06

[52] U.S. Cl. ..... 414/675; 53/390

[58] Field of Search ..... 414/675; 53/254, 390; 133/1 A, 8 R; 294/25; 222/365

[56] References Cited

U.S. PATENT DOCUMENTS

| | | | |
|---|---|---|---|
| 2,507,792 | 5/1950 | King | 414/675 |
| 2,771,198 | 11/1956 | Danchig | 414/675 |
| 2,941,342 | 6/1960 | Allen | 53/390 X |

*Primary Examiner*—L. J. Paperner

*Attorney, Agent, or Firm*—John N. Randolph

[57] ABSTRACT

A trough shaped receptacle for holding a plurality of small items, such as pills, screws, nuts, washers and the like, including a bottom portion having longitudinally spaced depressions in each of which a number of the items can collect, and a side portion having pockets in which separated groups are deposited when the holder is oscillated in one direction about its longitudinal axis, so that the items in each pocket can be quickly counted. The device or holder has a closed end into which excess items can be swept and held by the thumb of one hand of the user, employed to hold the device, and while the device is oscillated in the opposite direction and tilted downwardly toward its opposite end having a pouring lip through which the counted items are discharged by gravity.

6 Claims, 4 Drawing Figures

DEVICE FOR USE IN COUNTING SMALL ITEMS

SUMMARY

It is a primary object of the present invention to provide a device to facilitate the counting of small items which can be readily supported by either hand and manipulated for separating the articles contained therein into small groups each of which may be conveniently counted and thereafter totaled after which the counted items can be readily discharged from one end of the device by oscillating and tilting the device.

A further object of the invention is to provide a device of extremely simple construction containing no movable parts which can be very economically manufactured and sold and which will efficiently accomplish its intended function.

Various other objects and advantages of the invention will hereinafter become more fully apparent from the following description of the drawing, illustrating a presently preferred embodiment thereof, and wherein:

DESCRIPTION OF THE PREFERRED EMBODIMENT

Figure 1:
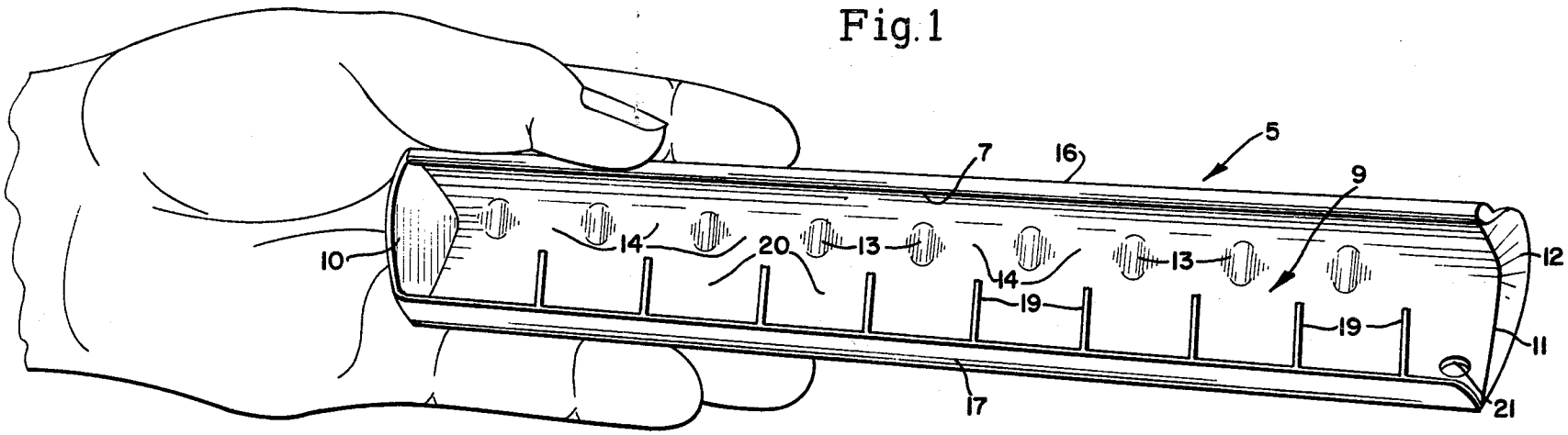
FIG. 1 is a top plan view of the device shown being held in a position for use.
Figure 2:
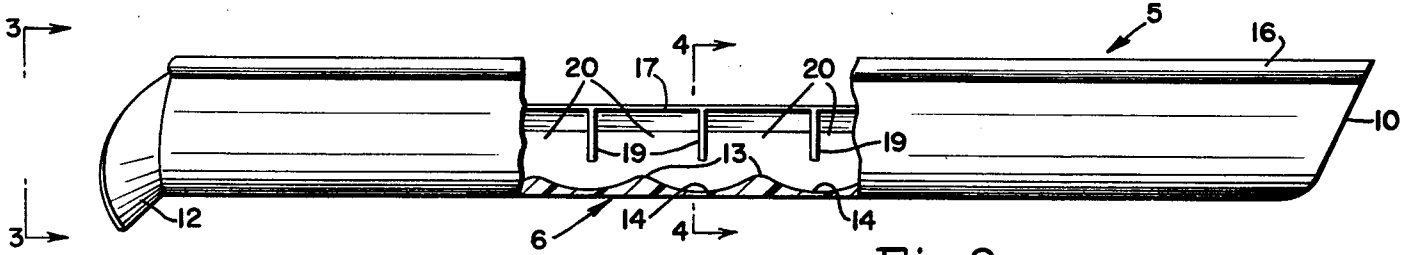
FIG. 2 is a side elevational view thereof, partly broken away, reversed end for end with respect to its position of FIG. 1.

Referring more specifically to the drawing, the device for use in counting small items comprises an elongated trough shaped holder 5 including a transversely rounded bottom portion 6 and side walls 7 and 8 which extend substantially from end to end of the holder. Side walls 7 and 8 diverge upwardly from the bottom 6 to form the upwardly opening trough 9 which extends substantially from end to end of the holder 5 and which is closed at one end by an end wall 10. The holder 5 has an open opposite end 11, defining an open end of the trough 9 and which is provided with a downwardly sloping pouring lip 12.

Figure 3:
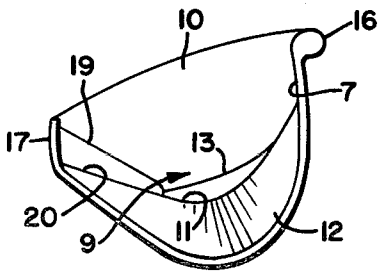
FIG. 3 is an end elevational view of the device, taken along a line 3—3 of FIG. 2.
Figure 4:
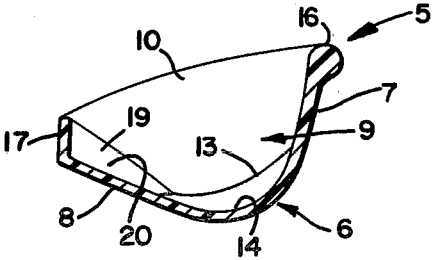
FIG. 4 is a cross sectional view thereof, taken substantially along a plane as indicated by the line 4—4 of FIG. 2.

The upper side of the bottom 6 has longitudinally spaced transversely extending ribs 13 between which are disposed transversely extending longitudinally spaced depressions 14. The wall 7 has an upper portion (FIGS. 3 & 4) which preferably terminates in a reinforcing head 16. The wall 8 has an inturned upper edge portion 17 extending from end to end thereof and is provided with spaced partitions 19 which extend inwardly from said inturned edge 17. The partitions 19 have outer edges which converge toward the wall 8 and merge therewith adjacent the bottom 6. Said partitions 19 combine with the wall 8 and its inturned edge portion 17 to define pockets 20.

The device 5 may be held in the hand, as illustrated in FIG. 1 with the walls 7 and 8 extended upwardly from the bottom 6. Small items, not shown, such as pills, nuts, screws, washers and the like may be poured into the holder 5 between the bead 16 and the wall portion 17 and will come to rest in the depressions 14 between the ribs or ridges 13. The holder or trough member 5 is preferably inclined slightly while being thus loaded so that its open end 11 is above the level of the end wall 10 to prevent any of the items escaping from said open end 11. The holder or trough member 5 is then oscillated about its longitudinal axis in a counterclockwise direction relative to FIGS. 3 and 4 for positioning the wall 8 in a bottommost position and so that the items separated by the ridges 13 can flow from the depressions 14 into the pockets 20. The small number of items contained in each pocket 20 can be readily counted and the items of the various pockets quickly totaled after which the holder 5 can be oscillated in the opposite direction to return the items to the bottom 6 from which they can be discharged over the lip 12 by tilting the holder endwise and so that the open end 11 will be disposed below the level of the closed end 10. The pocket 20 located adjacent the end wall 10 may be utilized for temporarily storing any excess items over and above the number required which may be held in said inner end pocket by the thumb of the hand supporting the holder. An opening 21 may be provided adjacent the open end 11 to enable the holder 5 to be hung up when not in use.

The holder 5 may be formed of any suitable substantially rigid material, preferably plastic. The number of pockets 20 may vary and the ribs 13 may be located staggered relative to the partitions 19 or may be in alignment therewith. The inner edge of the wall portion 17 may be provided with a reinforcing bead like the bead 16, and various other modifications and changes are contemplated and may be resorted to without departing from the function or scope of the invention.

I claim as my invention:

1. A device to facilitate the counting of small items comprising an elongated trough shaped holder having a closed end and an open discharge end, said holder including a transversely rounded bottom adapted to receive a number of small items to be counted and upwardly diverging side walls, the upper surface of said bottom having means for separating the items into small groups, and one of said side walls having inwardly opening pockets to receive the separated items when the holder is oscillated about its longitudinal axis in a direction to cause the side wall having said pockets to assume a bottommost position, whereby the small number of items contained in each pocket may be readily counted and the contents of all the pockets quickly totaled prior to oscillating the holder in the other direction for returning the items to said bottom and so that the items may be discharged through the open end of the holder when the holder is tilted endwise to cause said open end to assume a lowermost position.

2. A device as in claim 1, said open end having a downwardly inclined pouring lip.

3. A device as in claim 1, said aforementioned side wall having an inturned free edge portion, and a plurality of partitions longitudinally spaced relative to one another and extending inwardly from said edge portion and terminating adjacent said bottom to define said pockets each of which opens into the bottom.

4. A device as in claim 3, said other end wall being curved inwardly and terminating in a beaded edge which combines with said inturned edge portion of the first mentioned side wall to define the open top of the holder.

5. A device as in claim 1, the innermost pocket, disposed between said end wall and the partition located adjacent thereto, constituting a storage compartment for receiving and holding excess items and which can be confined in said pocket by the thumb of the hand supporting the holder.

6. A device as in claim 1, said means for separating the items while lodged on said bottom comprising longitudinally spaced transversely extending depressions formed by and disposed between transversely extending longitudinally spaced ridges.

* * * * *